US011686093B2

(12) United States Patent
Grande

(10) Patent No.: US 11,686,093 B2
(45) Date of Patent: Jun. 27, 2023

(54) COVER FOR LINTELS OR ANGLE IRONS

(71) Applicant: Royal Building Supplies Ltd., Toronto (CA)

(72) Inventor: Frank Grande, Toronto (CA)

(73) Assignee: Royal Building Supplies Ltd, Toronto (CA)

( * ) Notice: Subject to any disclaimer, the term of this patent is extended or adjusted under 35 U.S.C. 154(b) by 8 days.

(21) Appl. No.: 17/479,891

(22) Filed: Sep. 20, 2021

(65) Prior Publication Data

US 2023/0086840 A1 Mar. 23, 2023

(51) Int. Cl.

| | |
|---|---|
| ***E04C 3/02*** | (2006.01) |
| ***E04B 1/64*** | (2006.01) |
| *E04B 9/06* | (2006.01) |

(52) U.S. Cl.

CPC ..... *E04C 3/02* (2013.01); *E04B 1/642* (2013.01); *E04B 2009/062* (2013.01); *E04C 2003/023* (2013.01)

(58) Field of Classification Search

CPC ..... E04C 3/02; E04C 2003/023; E04C 3/07; E04B 1/642; E04B 2009/062

USPC ..... 52/204.2

See application file for complete search history.

(56) References Cited

U.S. PATENT DOCUMENTS

| | | | | | |
|---|---|---|---|---|---|
| 1,370,160 | A * | 3/1921 | Schenk | E04C 3/02 | 52/204.2 |
| 2,292,459 | A * | 8/1942 | Martin | E04C 3/02 | 52/204.2 |
| 2,510,845 | A * | 6/1950 | Waters | E06B 1/702 | 52/204.5 |
| 4,081,941 | A * | 4/1978 | Van Ausdall | E04B 1/92 | 52/837 |
| 5,222,345 | A | 6/1993 | Riley | | |
| 5,584,150 | A | 12/1996 | Newman | | |
| D882,125 | S * | 4/2020 | Divito | D25/199 | |
| 11,091,912 | B2 * | 8/2021 | Divito | E04C 3/02 | |
| 2019/0194934 | A1 * | 6/2019 | Divito | E04B 1/642 | |
| 2020/0248452 | A1 | 8/2020 | Divito | | |

FOREIGN PATENT DOCUMENTS

| | | |
|---|---|---|
| CA | 2926843 A1 | 10/2017 |
| GB | 2118585 A | 11/1983 |

* cited by examiner

*Primary Examiner* — Brent W Herring
(74) *Attorney, Agent, or Firm* — BakerHostetler

(57) ABSTRACT

The present invention relates to a lintel or angle iron cover, and specifically a cover for an L-shaped lintel having a rise portion and a run portion. The cover is also L-shaped and is a continuous wall made up of an upper wall joined to a top wall which is joined to a side wall. The side wall is also joined to a bottom wall which is joined to a back wall. Further, the upper wall is at least as high as the rise portion of the lintel. The top wall and bottom wall form a U-shaped opening closed by the side wall, and the U-shaped opening is the size of the run portion. Whereas the back wall forms a lip at the end of the bottom wall.

20 Claims, 5 Drawing Sheets

COVER FOR LINTELS OR ANGLE IRONS

FIELD OF THE INVENTION

The invention relates to the field of construction, and specifically to a cover that may be used on lintels or angle irons.

BACKGROUND OF THE INVENTION

Lintels and angle irons may be used as structural supports at the top of building openings such as windows, doors, fireplaces, etc. to transfer the load of the wall above the opening of the window or door. Alternatively, a lintel may be solely decorative and have no load bearing function. Lintels may be made of materials such as wood, stone, brick, concrete, or metal, however, in current construction, lintels are often made of metal.

Lintels used in construction are generally L-shaped and configured so that the rise of the "L" is substantially perpendicular to the opening and the run of the "L" is substantially adjacent to the opening. The rise of the lintel is commonly a height of 2.5 inches or 5 inches and the run of the lintel has a common length of 3.5 inches.

Lintels may deteriorate over time as a result of being subject to weather, general wear and tear, etc. Deterioration of a lintel often occurs because it is in contact with water due to improper drainage. Usually, the space between a lintel and a wall/brick is not sealed or otherwise caulked so that drainage is possible, and water is not trapped inside the interior of a wall/brick.

Lintel covers may be used to prevent corrosion or deterioration of the lintel in order to extend the lifespan of the lintel and/or avoid replacing the lintel. A lintel cover may be as simple as priming and painting the lintel with a waterproof paint, however, they are more commonly a physical structure that covers the lintel in part or in its entirety. Ideally, tar paper or another waterproofing membrane is placed over the lintel cover so that water is directed down a structure and off of the lintel cover.

UK Patent Application No. 2118585 teaches an elongated lintel over which a flexible and waterproof material is placed and secured along the length of the lintel using clips. U.S. Pat. No. 5,222,345 also teaches an overlay structure to cover existing interior and exterior frame works such as windows and doors, where the overlay is a highly flexible elongated laminar member with a generally planer out facing layer and a corrugated inner facing layer.

U.S. Pat. No. 5,584,150 teaches a removable angle iron cover having a first wall, a second wall, and a securing means. U.S. patent application Ser. No. 16/705,050 (Publication No. 20200248452) discloses a lintel cover having an upper surface, side surface, lower surface, and lip where the lip is shorter than the height of an upper portion of the lintel to increase the ease of installation, namely less than 5 inches or less than 2.5 inches.

It is difficult to keep these lintel covers in place as a lintel cover may slide across the width of the lintel and they are cumbersome to install as they require additional clips and fastening means. Moreover, a cover having a lip less than the height of the lintel may lead to exposure of the top of the lintel through which water or other debris may enter if tar paper or another waterproofing membrane is not installed or not installed properly over the lip of the cover.

Another wrap for steel lintels is disclosed in Canadian Patent No. 2926843 comprising a hinged plastic sheet that is contoured to cover a steel lintel across the width of a structural opening, where the top end of the plastic sheep has a flap and a hinge bend that forms a sealed air space between the structure and the steel lintel when it is installed. This wrap is cumbersome to install.

There is a need for a cover for a lintel or angle iron that is easy to install, stays in place and protects the entire exterior facing surface of the lintel.

SUMMARY OF THE INVENTION

In an embodiment of this invention there is a cover for a substantially L-shaped lintel having a rise portion and a run portion. The cover is also substantially L-shaped and is a continuous wall made up of an upper wall joined to a top wall which is joined to a side wall. The side wall is also joined to a bottom wall which is joined to a back wall. The upper wall is at least as high as the rise portion of the lintel. The top wall and bottom wall form a U-shaped opening closed by the side wall, and the U-shaped opening is the size of the run portion. Further, the back wall forms a lip at the end of the bottom wall.

In a further embodiment of this invention, the height of the upper wall of the cover is greater than the height of the rise portion of the lintel.

In another embodiment of this invention, the upper wall of the cover is at least 5 inches in length.

In another embodiment of this invention, the upper wall of the cover is at least 5 inches in length, the top wall is approximately 3.250 inches in length, the side wall is approximately 0.390 inches in length, the bottom wall is approximately 3.5 inches in length, and the back wall is approximately 0.5 inches in length.

In another embodiment of this invention, the width of each of the upper wall, the top wall, the side wall, the bottom wall, and the back wall of the cover is 0.05 inches.

In another embodiment of this invention, the length of the cover is 12 feet.

In another embodiment of this invention, the cover is made of polyvinyl chloride.

In yet another embodiment of this invention, the cover is made of rigid polyvinyl chloride.

BRIEF DESCRIPTION OF THE DRAWINGS

These and other aspects of the present invention will be apparent from the brief description of the drawings and the following detailed description in which.

DETAILED DESCRIPTION OF THE DRAWINGS

The present invention is a cover for a lintel or an angle iron for use in constructing a building.

Figure 1:
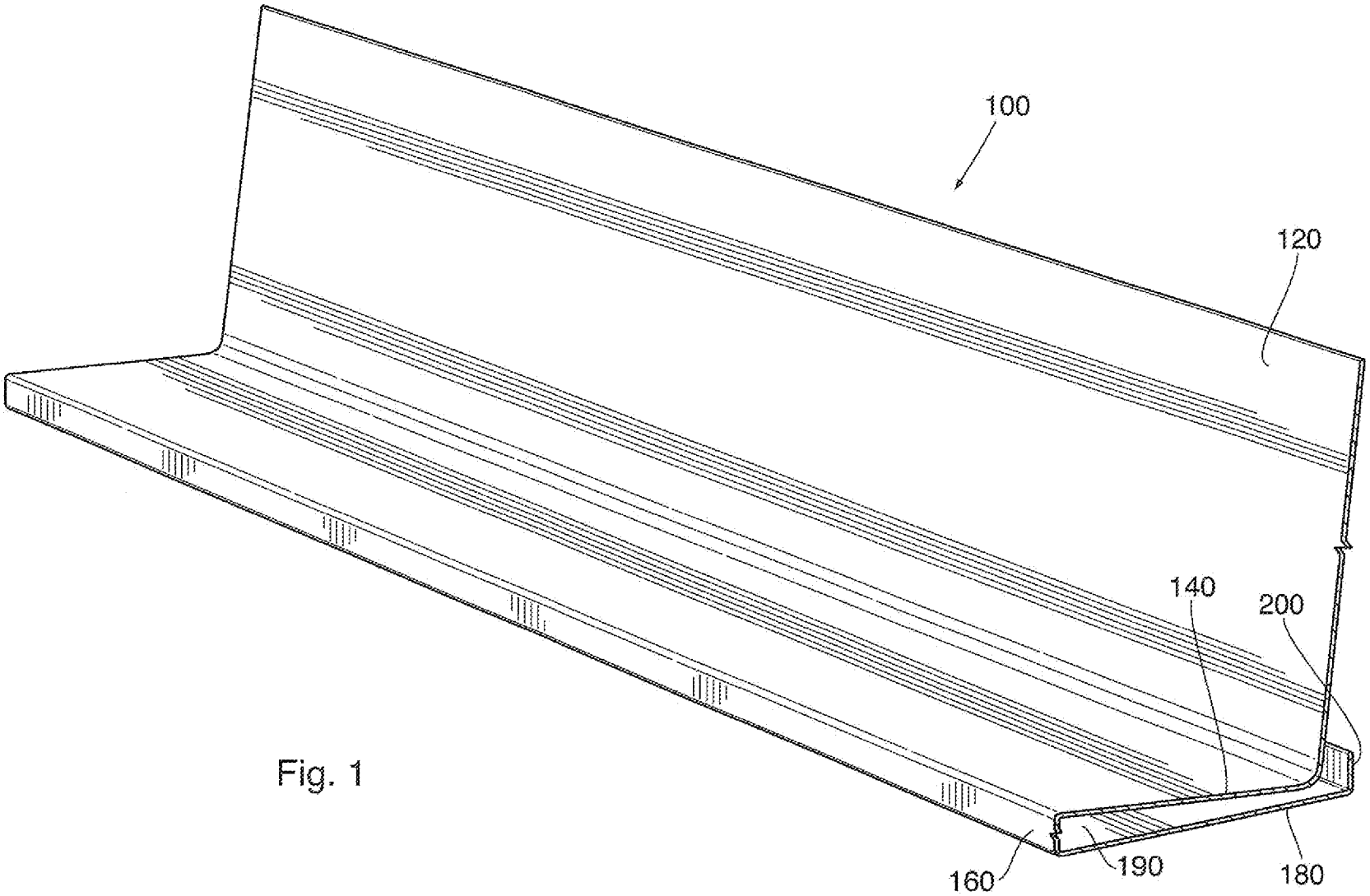
FIG. 1 is a perspective view of a section of a lintel cover according to an embodiment of the present invention.
Figure 2:
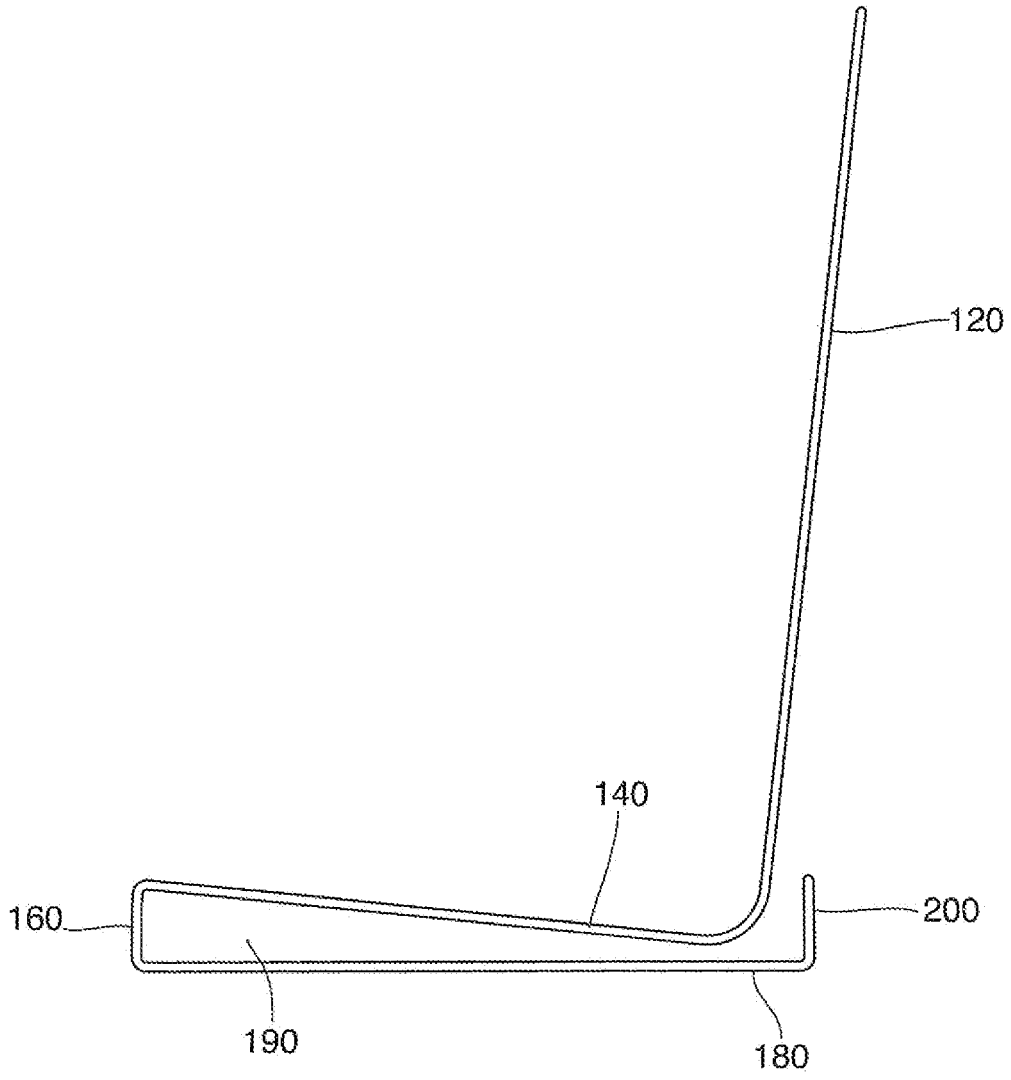
FIG. 2 is a side view of the lintel cover of FIG. 1.

As seen in FIGS. 1 and 2, in an embodiment of the present invention the cover 100 comprises a flexible single structure that is formed to have five walls configured to wrap around an L-shaped lintel, namely, an upper wall 120, a top wall 140, a side wall 160, a bottom wall 180, and a back wall 200. An opening 190 is formed between the top wall 140 and bottom wall 180.

The upper wall 120 and the top wall 140 are substantially perpendicular to each other. The side wall 160 and the bottom wall 180 are substantially perpendicular, and the back wall 200 and the bottom wall 180 are substantially perpendicular to one another. The top wall 140 and side wall 160 are slightly less than perpendicular to one another so that when the flexible cover 100 is installed on a lintel 50, the top wall 140 (which is not parallel to the bottom wall 180 when not covering a lintel 50) becomes substantially parallel to the bottom wall 180. As a result, the top wall 140 of the cover 100 helps to hold the cover in place on the lintel.

It is understood that the parts of the present invention are named as if they have been installed over a traditional window or door opening, but it is nevertheless understood that they may be oriented in any direction when not installed.

Figure 3:
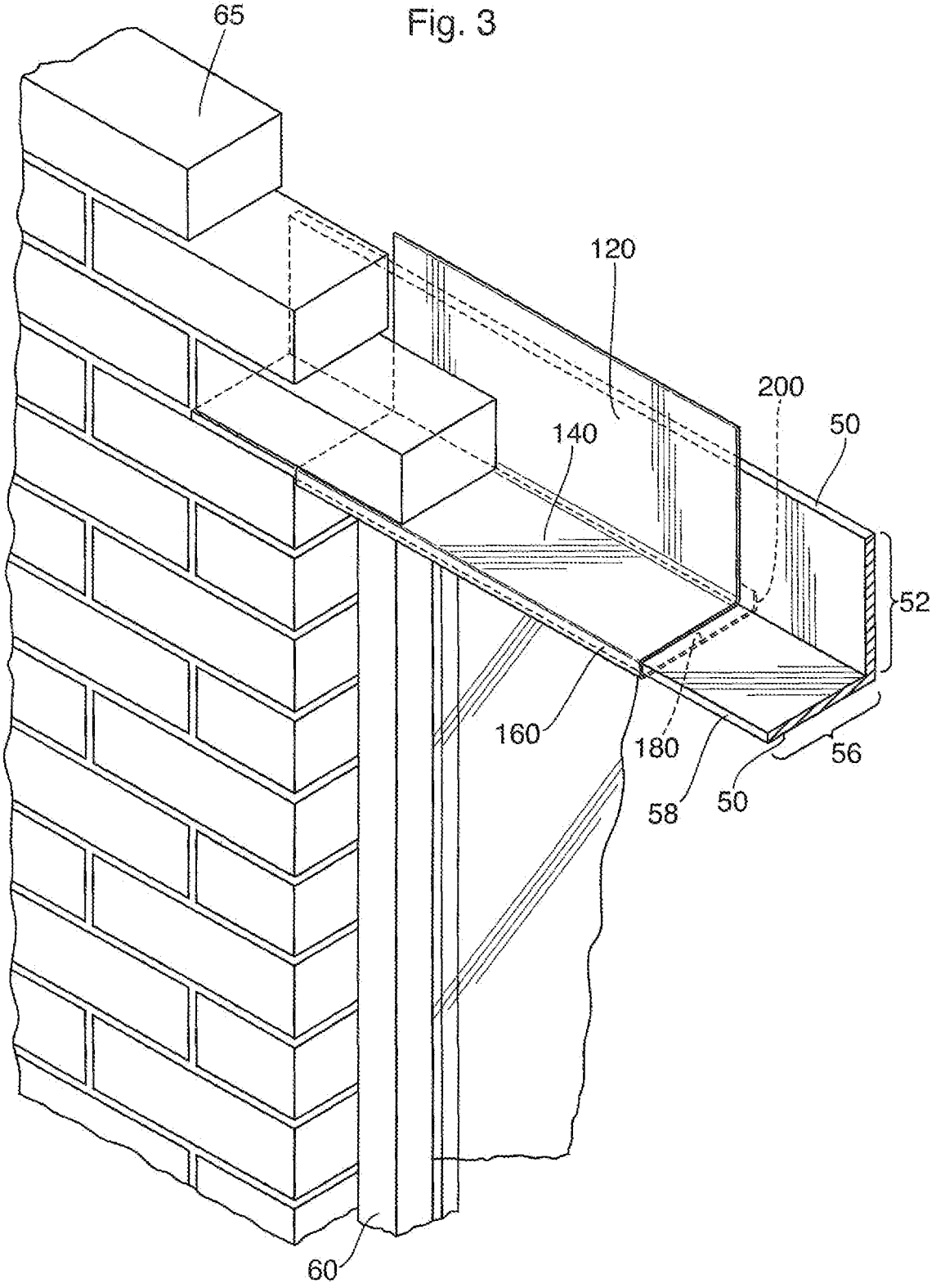
FIG. 3 is an environmental perspective view of a lintel cover according to an embodiment of the present invention installed on a lintel over a window.
Figure 4:
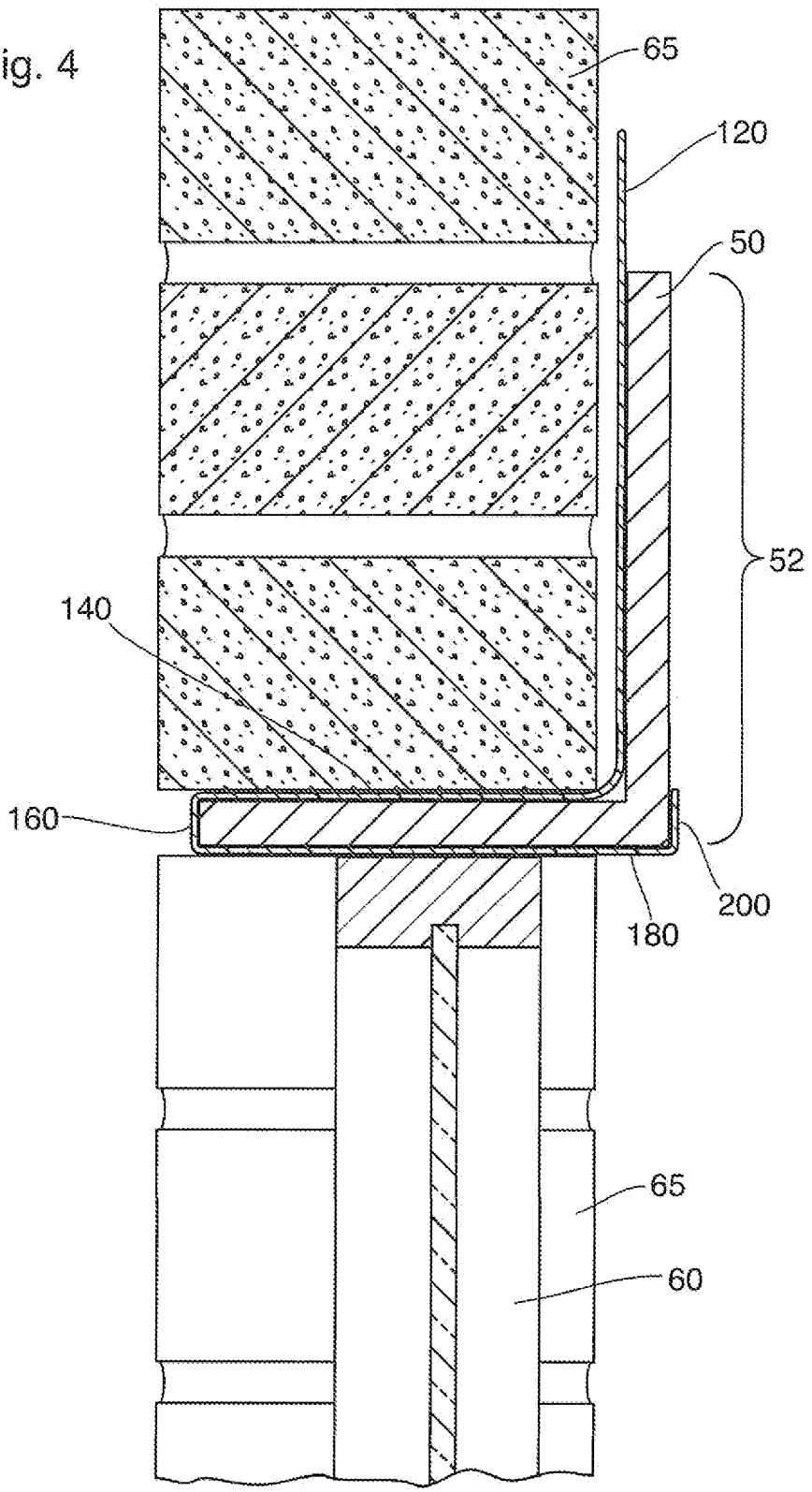
FIG. 4 is a cross-sectional view of a lintel cover according to an embodiment of the present invention installed on a lintel over a window.

FIGS. 3 and 4 each show a lintel cover installed on a lintel 50 over a window frame 60 in a building structure of bricks 65.

As seen in FIG. 3, the cover 100 is shown installed over a lintel 50 with an L-shaped configuration wherein the rise of the "L" 52 is substantially perpendicular to the opening 190 (shown in FIG. 2) and the run of the "L" 56 is substantially adjacent to the opening 190. In this embodiment of the present invention, the upper wall 120 covers the entirety of the exterior facing rise 52 of the lintel, the top wall 140 covers the entirety of the top run 56 of the lintel, the side wall 160 covers the entirety of the exterior facing rise 58 of the lintel, the bottom wall 180 covers the entirety of the bottom of the run 56 of the lintel, and the back wall 200 covers a portion of the interior facing rise 52 of the lintel. In this embodiment of the present invention, the upper wall 120 is taller than the rise 52 of the lintel. The angle between the top wall 140 and side wall 160 is substantially perpendicular to one another when the cover is installed on a lintel.

As best seen in FIG. 4, in an embodiment of the present invention, the height of the upper wall 120 is the same height of the rise 52 of the lintel 50. There is no gap between the lintel cover and the lintel and the cover is fit tight to the lintel. The back wall 200 acts to secure the cover 100 to the lintel 50. The cover is able to surround and protect the surfaces of the lintel that the cover is adjacent to without the cover moving.

Figure 5:
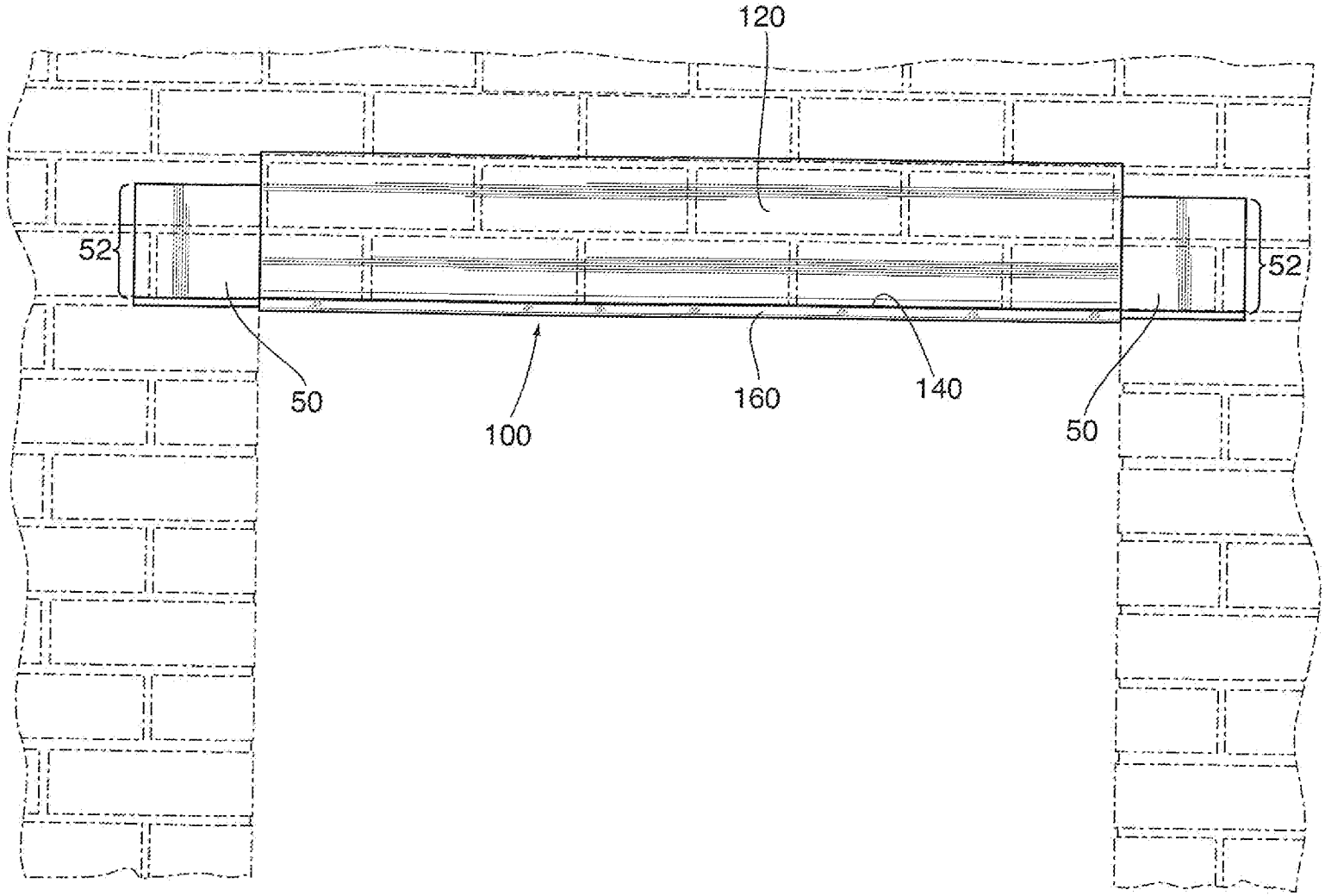
FIG. 5 is a front view of a lintel cover installed on a lintel over the interior opening of a building structure.

As seen in FIG. 5, in an embodiment of the invention, the upper wall 120 is higher than the height of the rise 52 of the lintel 50. In the embodiment of the cover shown in FIGS. 3 and 5, the cover spans the portion of the lintel over the window or door or other building opening, but it is nevertheless understood that the lintel cover can cover the entire span of the lintel.

In an embodiment of the present invention the upper wall 120 is at least 5 inches in length, the top wall 140 is approximately 3.250 inches in length, the side wall 160 is approximately 0.390 inches in length, the bottom wall 180 is approximately 3.5 inches in length, and the back wall 200 is approximately 0.5 inches in length. In an embodiment of the present invention, the width of each wall is 0.05 inches thick. These dimensions allow the cover 100 to fit over a standard sized lintel or angle iron 50.

The upper wall 120 is at least 5 inches long and the cover 100 is intended to cover at least the rise 52 of a standard 5-inch lintel and will also cover a standard 2.5-inch lintel. Having a cover as high, or higher, than the rise 52 of a lintel 50 does not add significant weight or materials to the overall structure and provides better coverage of the lintel and requires less tar paper/waterproof membrane to be placed over the lintel cover. Additionally, in the event that the tar paper/waterproof membrane is to be secured to the lintel cover (not shown), having the cover higher than the lintel allows for the tar paper/waterproof membrane to be secured to the lintel cover above the top rise 52 of the lintel 50 using tape, sheathing tape, glue, other adhesives, nails, nail gun, staple gun, etc. without the fasteners coming into contact with the lintel 50.

In an embodiment of the present invention, sheathing tape (not shown) can be adhered to the upper wall 120 of an installed lintel cover 100 without risk of contacting the lintel 50. This makes the installation of the tar paper/waterproof membrane easier as an installer will not accidentally apply the tar paper/waterproof membrane to the lintel directly as it is entirely protected by the lintel cover. This prevents any condensation or water from coming into contact with the lintel, thus preserving the lifespan of the lintel.

In an embodiment the length of the cover 100 is 12 feet long, but it is understood that the length may be longer or shorter depending on the length of the lintel and/or building opening.

In operation, the cover 100 is installed on a lintel 50 in place above an opening of a building during construction of the building. The cover 100 may be pre-measured or cut to the size of the lintel 50, or the cover may require no adjustment in length to fit the length of the lintel. The cover 100 can be slid along the length of the lintel such that the upper wall 120 is aligned with the rise 52 of the lintel facing the exterior of the building or structure, the top wall 140 is aligned with the top of the run 56 of the lintel, the bottom wall 180 is aligned with the bottom of the run 56 of the lintel, and the back wall 200 is aligned with the rise 52 of the lintel facing the interior of the building or structure. As the cover 100 is flexible, when being slid along the lintel 50, the top wall 140 of the cover 100 moves so that it becomes substantially perpendicular to the side wall 160. This creates a friction fit between the cover 100 and the lintel 50, and acts to keep the cover 100 in tight to the lintel 50 as the top wall 140 contacts and puts pressure on the top run 56 of the lintel 50. The back wall 200 acts to both provide further protection to the lintel and to keep the cover on place more easily. No adhesives or fasteners are required to keep the cover 100 in place on the lintel 50.

Once the cover 100 is installed on the lintel 50, a construction wrap/tar paper/waterproofing membrane, such as Tyvek™, is placed over the upper wall 120 so that when water flows down the surface of a building or structure, it flows over the construction paper and off of the cover 100 and does not contact the lintel 50. What is more, when there is a seam or overlap of tar paper on the lintel cover (as tar paper comes in sheets, two pieces of tar paper may be adhered together forming a seam to protect the structure) allowing the tar paper to be adhered to the upper wall 120 of the lintel cover 100 acts to protect the lintel from wind, condensation, rain or other elements coming through that may otherwise damage the lintel 50. Thus, the lintel 50 is protected from rusting, corrosion, oxidation, etc. by keeping external elements out from between the cover 100 and the lintel 50.

In an embodiment of the present invention the cover 100 is extruded from polyvinyl chloride (PVC). In a further embodiment of the present invention the cover is extruded rigid polyvinyl chloride (RPVC), which is a non-flammable material that is resistant to weathering.

While embodiments of the invention have been described in the detailed description, the scope of the claims should not be limited by the preferred embodiments set forth in the examples but should be given the broadest interpretation consistent with the description as a whole.

What is claimed is:

1. A flexible cover for a substantially L-shaped lintel having a rise portion and a run portion, said cover being a substantially L-shaped continuous wall comprised of an upper wall joined to a top wall joined to a side wall joined to a bottom wall joined to a back wall, wherein the upper wall is at least as high as the rise portion of the lintel, the top wall and bottom wall form a U-shaped opening closed by the side wall, which opening is the size of the run portion, and the back wall forms a lip at the end of the bottom wall, wherein the back wall and side wall are substantially parallel, and the distance between the top wall and bottom wall is greater at the side wall than at the back wall such that the top wall and bottom wall are not parallel to one another, and wherein the top wall of the flexible cover holds the cover in place when installed on the substantially L-shaped lintel.

2. The cover of claim 1, wherein the height of the upper wall is greater than the height of the rise portion of the lintel.

3. The cover of claim 2, wherein the upper wall is at least 5 inches in length.

4. The cover of claim 3, wherein the thickness of each of the upper wall, the top wall, the side wall, the bottom wall, and the back wall is 0.05 inches.

5. The cover of claim 2, wherein the upper wall is at least 5 inches in length, the top wall is approximately 3.250 inches in length, the side wall is approximately 0.390 inches in length, the bottom wall is approximately 3.5 inches in length, and the back wall is approximately 0.5 inches in length.

6. The cover of claim 2, wherein the thickness of each of the upper wall, the top wall, the side wall, the bottom wall, and the back wall is 0.05 inches.

7. The cover of claim 2, wherein the length of the cover is 12 feet.

8. The cover of claim 2, wherein the cover is made of polyvinyl chloride.

9. The cover of claim 1, wherein the upper wall is at least 5 inches in length.

10. The cover of claim 9, wherein the thickness of each of the upper wall, the top wall, the side wall, the bottom wall, and the back wall is 0.05 inches.

11. The cover of claim 9, wherein the length of the cover is 12 feet.

12. The cover of claim 9, wherein the cover is made of polyvinyl chloride.

13. The cover of claim 1, wherein the upper wall is at least 5 inches in length, the top wall is approximately 3.250 inches in length, the side wall is approximately 0.390 inches in length, the bottom wall is approximately 3.5 inches in length, and the back wall is approximately 0.5 inches in length.

14. The cover of claim 13, wherein the length of the cover is 12 feet.

15. The cover of claim 13, wherein the cover is made of polyvinyl chloride.

16. The cover of claim 1, wherein the thickness of each of the upper wall, the top wall, the side wall, the bottom wall, and the back wall is 0.05 inches.

17. The cover of claim 16, wherein the length of the cover is 12 feet.

18. The cover of claim 1, wherein the length of the cover is 12 feet.

19. The cover of claim 1, wherein the cover is made of polyvinyl chloride.

20. The cover of claim 1, wherein the cover is made of rigid polyvinyl chloride.

* * * * *